US008656554B1

(12) United States Patent
Burleson

(10) Patent No.: US 8,656,554 B1
(45) Date of Patent: Feb. 25, 2014

(54) GATE CLOSER

(76) Inventor: Isaac S. Burleson, Fletcher, NC (US)

( * ) Notice: Subject to any disclaimer, the term of this patent is extended or adjusted under 35 U.S.C. 154(b) by 0 days.

(21) Appl. No.: 13/364,625

(22) Filed: Feb. 2, 2012

(51) Int. Cl.
*E05F 1/00* (2006.01)
*E05F 1/10* (2006.01)

(52) U.S. Cl.
USPC ..... 16/78; 16/72

(58) Field of Classification Search
USPC ..... 16/78, 71, 72, 76, 61, 63; 49/404; 256/73
See application file for complete search history.

(56) References Cited

U.S. PATENT DOCUMENTS

| | | | | | |
|---|---|---|---|---|---|
| 433 | A | * | 10/1837 | Richardson | 16/78 |
| 7,132 | A | * | 3/1850 | Barnard | 16/78 |
| 36,647 | A | * | 10/1862 | Gilfillan | 16/78 |
| 116,644 | A | * | 7/1871 | Taber | 16/78 |
| 136,482 | A | | 3/1873 | Bean et al. | |
| 137,770 | A | | 4/1873 | Foster | |
| 149,941 | A | * | 4/1874 | McKay | 242/375.1 |
| 155,129 | A | | 9/1874 | Warren | |
| 176,539 | A | * | 4/1876 | Klein | 16/280 |
| 224,377 | A | | 2/1880 | Barker | |
| 228,856 | A | | 6/1880 | Bauman | |
| 274,397 | A | * | 3/1883 | Sherer | 16/78 |
| 436,506 | A | * | 9/1890 | Spencer | 49/387 |
| 506,213 | A | * | 10/1893 | Dickson | 49/387 |
| 536,881 | A | | 4/1895 | Larimer | |
| 618,446 | A | * | 1/1899 | Sparks | 49/387 |
| 793,731 | A | * | 7/1905 | Meyer | 16/80 |
| 900,956 | A | * | 10/1908 | Remontet | 16/64 |
| 1,100,952 | A | * | 6/1914 | Bujewski | 16/81 |
| 1,135,324 | A | | 4/1915 | Robieson | |
| 1,350,134 | A | * | 8/1920 | Bellican | 16/72 |
| 1,380,312 | A | * | 5/1921 | Bellican | 16/286 |
| 1,471,830 | A | * | 10/1923 | Corey | 16/72 |
| 1,790,304 | A | * | 1/1931 | House | 49/34 |
| 1,802,444 | A | | 4/1931 | Noel | |
| 1,908,984 | A | * | 5/1933 | Katz | 16/72 |
| 2,485,076 | A | * | 10/1949 | Timerman | 337/184 |
| 2,827,265 | A | * | 3/1958 | McKillop | 256/41 |
| 2,992,450 | A | * | 7/1961 | Pittenger | 16/78 |
| 3,018,507 | A | * | 1/1962 | Launer | 16/78 |
| 3,389,501 | A | | 6/1968 | Harmon | |
| 3,411,241 | A | * | 11/1968 | Harmon | 49/386 |
| 4,122,630 | A | | 10/1978 | Parisien | |
| 4,127,292 | A | * | 11/1978 | Mader | 292/246 |
| 4,628,638 | A | * | 12/1986 | Elko et al. | 49/426 |

(Continued)

FOREIGN PATENT DOCUMENTS

JP 08319754 A * 12/1996 ..... E05F 1/10

*Primary Examiner* — Victor Batson
*Assistant Examiner* — Jason W San
(74) *Attorney, Agent, or Firm* — Robert C. Montgomery; Montgomery Patent & Design

(57) ABSTRACT

A gate closer used to automatically close an existing fence gate upon opening in either direction includes a bracket attaches to and extending upwardly from a hinge side of the gate and over any existing fence post that supports the fixed side of the hinge. The outer end of the bracket provides an attachment to a cable, which is in turn connected to a stationary pulley and tension spring mounted to a top frame portion of the fence. The opposite end of the spring is connected to an adjustment rod used to adjust tension force of the spring. The cable provides a constant force on the bracket, which forces the bracket and attached gate to the neutral or closed position. The apparatus works regardless of which direction the gate is opened as it come to rest in the closed position.

5 Claims, 3 Drawing Sheets

(56) References Cited

U.S. PATENT DOCUMENTS

| | | | | | |
|---|---|---|---|---|---|
| 4,731,902 | A | | 3/1988 | Johnston | |
| 4,821,786 | A | * | 4/1989 | Johnston | 160/23.1 |
| 4,901,396 | A | * | 2/1990 | Tatematsu et al. | 16/76 |
| 5,313,739 | A | * | 5/1994 | Nelson et al. | 49/404 |
| 5,365,636 | A | * | 11/1994 | Jensen | 16/67 |
| 5,664,717 | A | * | 9/1997 | Joder | 224/502 |
| 5,732,508 | A | * | 3/1998 | Latta et al. | 49/386 |
| 6,035,921 | A | * | 3/2000 | Minow | 160/328 |
| 7,293,328 | B2 | | 11/2007 | Endres | |
| 7,325,842 | B1 | | 2/2008 | Lenz | |
| 7,472,457 | B2 | * | 1/2009 | Giovannetti | 16/78 |
| 7,503,547 | B2 | * | 3/2009 | Yoshida et al. | 254/245 |
| 8,464,414 | B2 | * | 6/2013 | Gutierrez | 29/428 |
| 8,533,909 | B2 | * | 9/2013 | Minegishi et al. | 16/76 |
| 2004/0052395 | A1 | * | 3/2004 | Sin | 381/361 |
| 2007/0266817 | A1 | * | 11/2007 | Lassiter | 74/551.8 |
| 2011/0219598 | A1 | * | 9/2011 | Gutierrez | 29/428 |
| 2013/0157813 | A1 | * | 6/2013 | Irving et al. | 482/57 |
| 2013/0248794 | A1 | * | 9/2013 | Callahan et al. | 256/73 |

* cited by examiner

GATE CLOSER

RELATED APPLICATIONS

There are currently no applications co-pending with the present application.

FIELD OF THE INVENTION

The present invention relates generally to gates, and in particular, to closing devices for gates.

BACKGROUND OF THE INVENTION

Bi-directional gates are attached to many outdoor fences to enable entrance from either direction. While these gates normally include a latching device many users forget or don't bother to utilize the latch and consequently leave the gate open. Leaving a gate open can enable animals to become loose or lost, children to wander from their home, and other similar situations can occur.

Various attempts have been made to provide a closing device for bi-directional gates. Examples of these attempts can be seen by reference to several U.S. patents. U.S. Pat. No. 1,802,444, issued in the name of Noel, describes an attachable gate closing device.

U.S. Pat. No. 7,293,328, issued in the name of Endres, describes a closing device for a gate.

U.S. Pat. No. 7,325,842, issued in the name of Lenz, describes an automatic gate closer.

While these devices fulfill their respective, particular objectives, each of these references suffer from one (1) or more disadvantages. Many devices are not suited to attach to gates which swing open in a bi-directional manner. Other are not suited to be retrofitted to an existing gate. Furthermore some do not include an automatic closing means. Accordingly, there exists a need for gate closer without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for an automatic gate closer which can be retrofitted to any bi-directional gate.

Accordingly, it is an object of the present embodiments of the invention to solve at least one (1) of these problems. The inventor has addressed this need by developing an automatic gate closer.

To achieve the above objectives, it is an object of the present invention to provide a gate closer.

Another object of the present invention is to provide the gate closer with a pivot assembly.

Yet still another object of the present invention is to provide the pivot assembly with an attached cable.

Yet still another object of the present invention is to provide the cable with a tensioner assembly to enable the cable to provide a constant tension force upon the pivot assembly to cause the existing gate to bias to a closed position while traveling along clockwise and counter clockwise directions towards the existing fence.

Yet still another object of the present invention is to provide a corner fitting attached to a rod to be attached to the existing fence.

Yet still another object of the present invention is to provide fasteners to attach the gate closer to an existing gate.

Yet still another object of the present invention is to provide the tensioner with a spring anchored to the cable and an adjustment knob to adjust a tension force of the spring.

Yet still another object of the present invention is to provide a method of utilizing a device that provides a means of attaching a cable to a pivot assembly, fixing a tensioner assembly to the top of an existing fence, and providing a tension force upon the pivot assembly to cause an existing gate to be biased toward a closed position.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
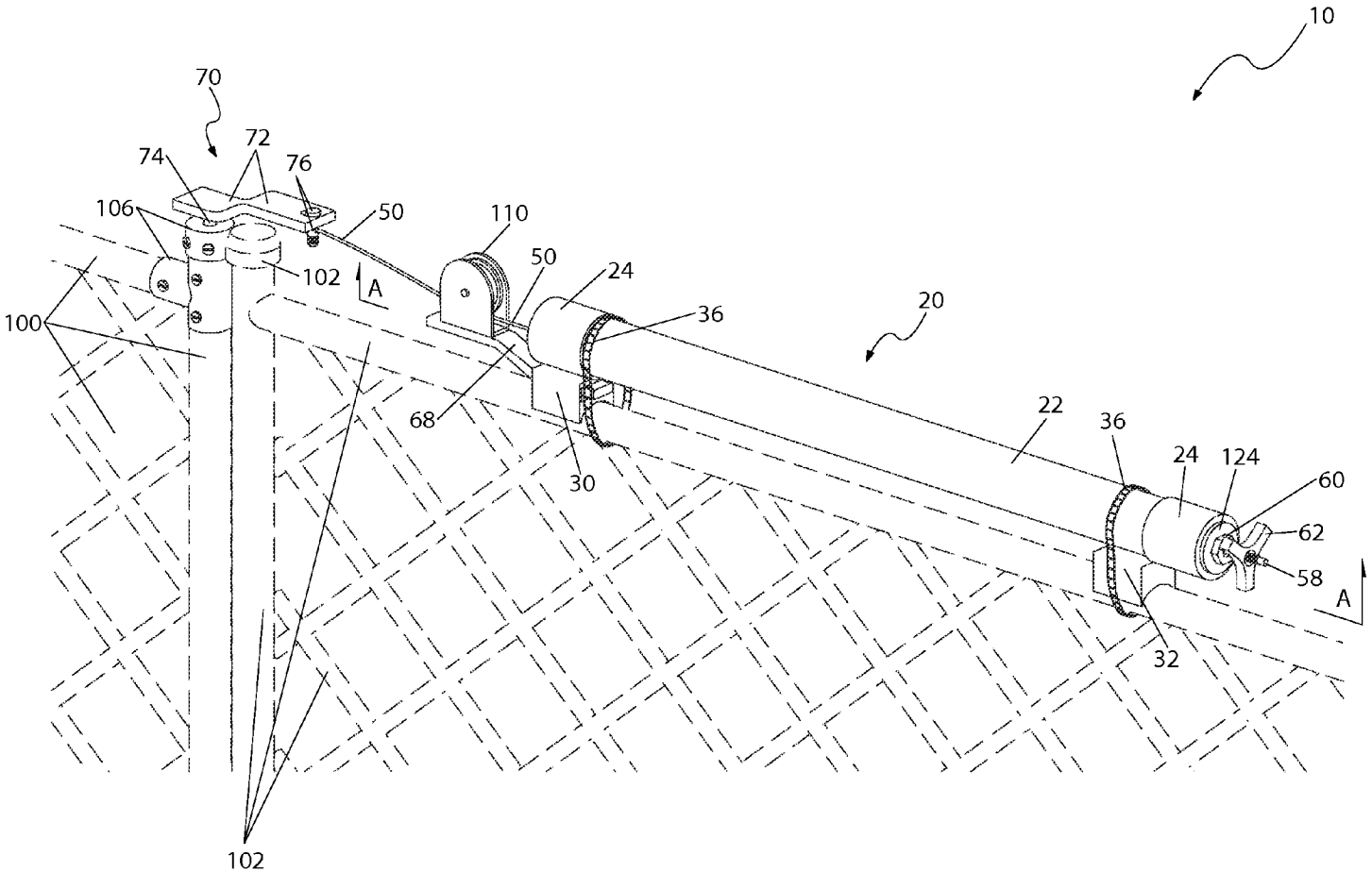
FIG. 1 is a side perspective view of a gate closer 10, according to a preferred embodiment of the present invention.

10 gate closer
20 tensioner assembly
22 spring tube
24 end cap
26 inner space
28 fastener aperture
30 first spacer
32 second spacer
36 anchor strap
50 cable
54 spring
56 "U"-bolt clamp
58 eye bolt
60 lock nut
62 adjustment knob
68 offset rod
70 pivot assembly
72 angle bracket
74 rod
76 cable pinch bolt
78 cable pinch bolt aperture
100 existing gate
102 existing fence
106 custom corner fitting
108 rod orifice
110 pulley assembly
112 pulley bracket
114 pulley
120 threaded fastener
122 set screw
124 washer

DETAILED DESCRIPTION OF THE PREFERRED EMBODIMENT

Figure 2:
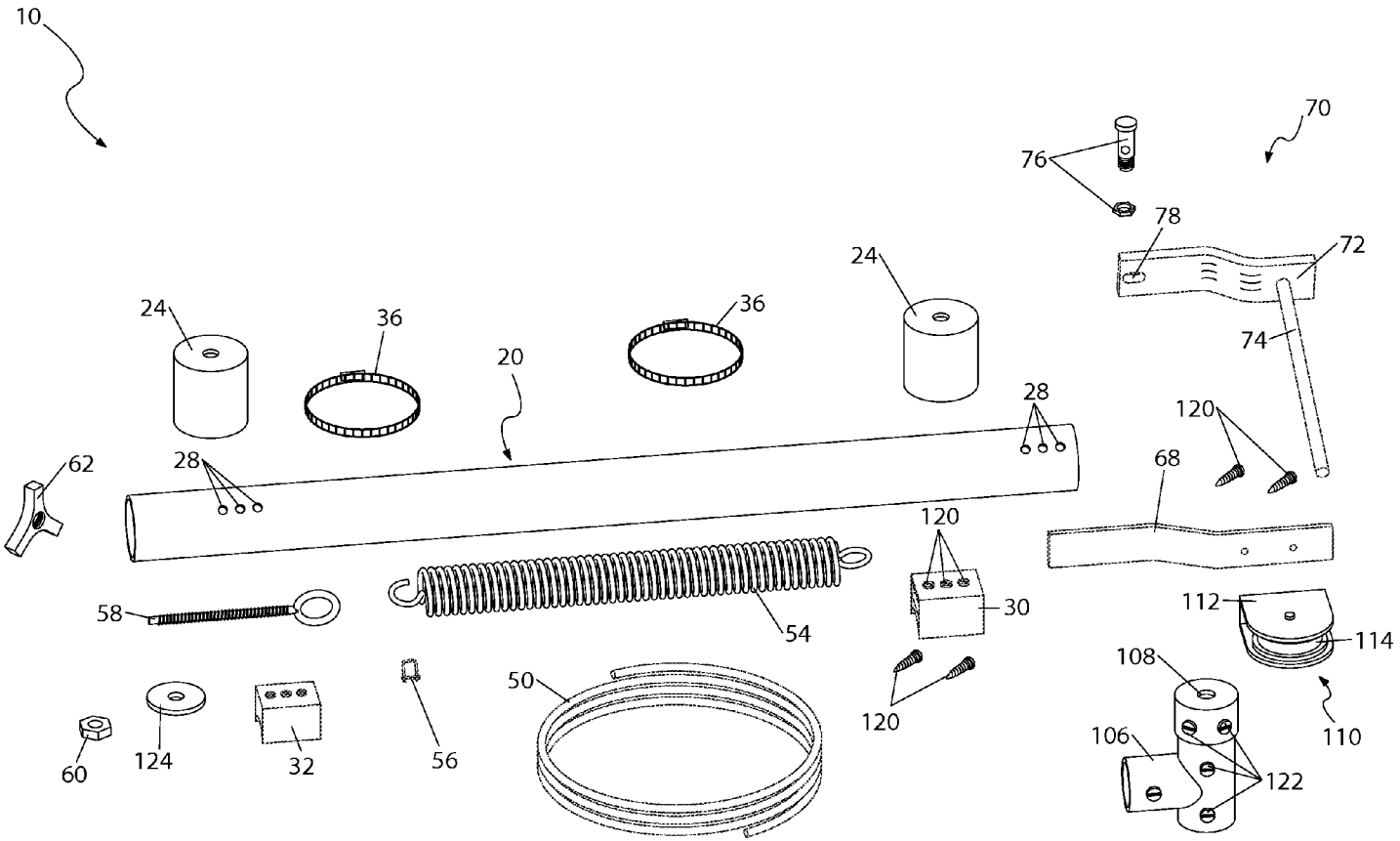
FIG. 2 is an exploded view of the gate closer 10, according to a preferred embodiment of the present invention; and, FIG. 3 is a section view of a tensioner assembly portion 20 of the gate closer 10 taken along section line A-A (see FIG. 1), according to a preferred embodiment of the present invention.
Figure 3:
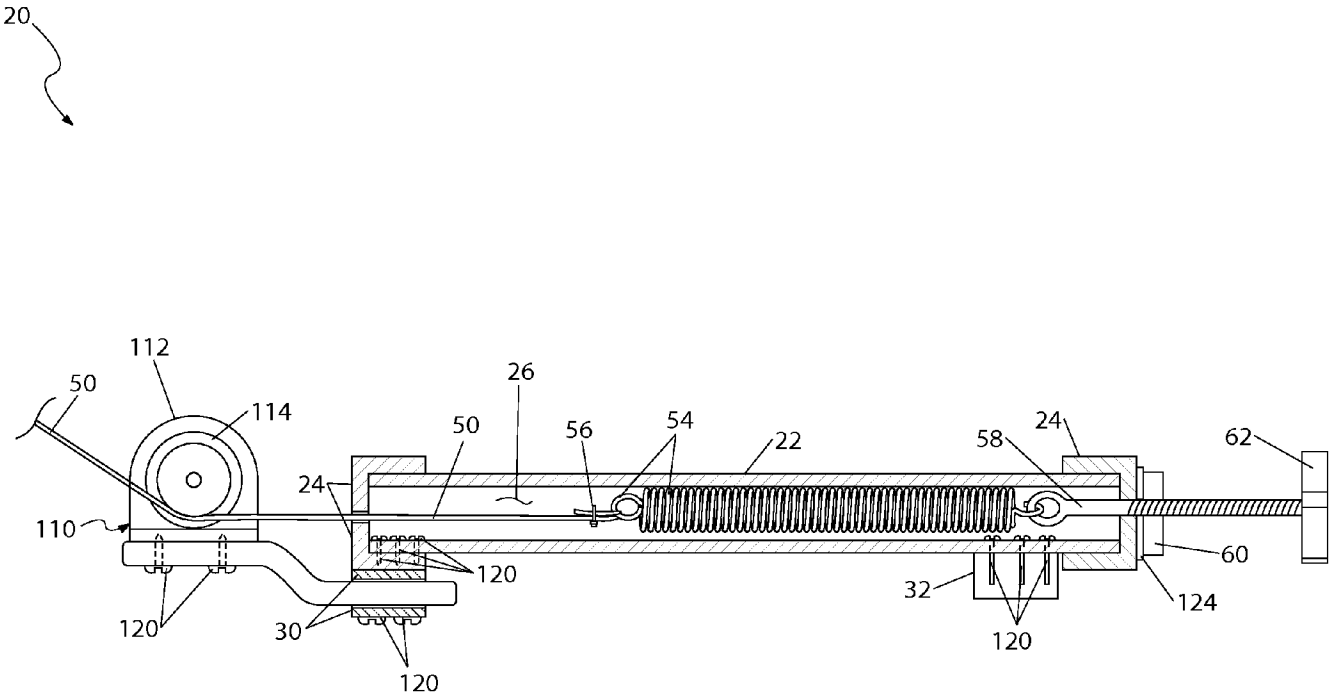

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, a side perspective view of a gate closer (herein described as the "apparatus") 10, which provides a means to automatically close an existing gate 100 of an existing fence 102. The existing gate 100 may swings in one or in both directions. The apparatus 10 comprises a pivot assembly 70 comprising a "Z"-shaped angle bracket 72 which is rigidly attached to an upper corner of the existing gate 100. The angle bracket 72 extends up and over any part of the existing fence 102, and is subsequently attached to a cable 50 via a standard cable pinch bolt device 76. The cable 50 provides a constant tension force upon the angle bracket 72 via attachment to a tension spring 54 which is located within a tubular tensioner assembly 20. The tubular tension assembly 20 is fixed to the top of the existing fence 102 (see FIG. 1). The opposite end of the tensioner assembly 20 includes a threaded adjustment knob 62 that is used to adjust the tension of a spring 54. In use, the cable 50 applies a bias force that causes the existing gate 100 to be biased toward a closed position. The apparatus 10 works equally well regardless of which direction the existing gate 100 swings.

The pivot assembly 70 comprises an integral "Z"-shaped angle bracket 72 which is attached to a hinged corner of the existing gate 100. The angle bracket 72 is attached to, and acted upon by the cable 50 (see FIGS. 1 and 3), thereby enabling the linear force exerted by the cable 50 to be converted into a biasing torsional force which acts upon the existing gate 100 to return the existing gate 100 to the closed position. The pivot assembly 70 further includes a rod 74 and a custom corner fitting 106. The custom corner fitting 106 has a plurality of integral set screws 122 for clamping the custom corner fitting 106 to the existing gate 100. This requires replacement of any existing top corner fittings of the existing gate 100 with the custom corner fitting 106. The custom corner fitting 106 enables attachment of the angle bracket 72 to the existing fence 100 by insertion of the angle bracket's 72 rod 74 into the custom corner fitting's 106 rod orifice 108. The apparatus 10 is envisioned as being introduced in kit form to fit popular fences 102 manufactured by companies such as, but not limited to: MERCHANT METALS INC.®, MASTER HALCO INC.®, and others. The rod 74 comprises a straight length of metal stock approximately three-quarters of an inch (¾ in.) in diameter and one foot (1 ft.) long that is welded to the bottom of the angle bracket 72 so as to extend downward. As noted the rod 74 is in mechanical communication with the custom corner fitting 106 by being inserted into the rod orifice 108 at the top of the custom corner fitting 106. The rod 74 is fixed in a position relative to the custom corner fitting 106 via a plurality of set screws 122 that are arranged around the custom corner fitting 106. In particular, it should be understood that the rod 74 does not rotate when the set screws 122 are tight.

As previously described, the cable 50 is attached to the distal end of the angle bracket 72 using a standard cable pinch bolt 76 which is inserted into a cable pinch bolt aperture 78 of the angle bracket 72. The cable 50 extends downward at an angle of approximately forty-five degrees (45°) to tangentially engage the bottom groove of the pulley 114. The pulley 114 aligns the cable 50 with the spring 54 within the tensioner assembly 20 (see FIGS. 2 and 3). The tensioner assembly 20 is securely attached to the top of the existing fence 102 via a pair of anchoring straps 36. The anchoring straps 36 are wrapped around the spring tube 22 and the top of the existing fence 102 and then tightened. This positions and attaches the tensioner assembly 20 to the existing fence 102 adjacent to the existing gate 100. The anchoring straps 36 are envisioned to comprise pipe clamps, tie-wraps, or equivalent binding devices.

Referring now to FIGS. 2 and 3, exploded and section views of the apparatus 10, according to a preferred embodiment of the present invention, are disclosed. The apparatus 10 comprises a tensioner assembly 20 and a pivot assembly 70. Said tensioner assembly 20 provides a spring-loaded means to apply an adjustable tension upon the pivot assembly 70. Said tensioner assembly 20 comprises a spring tube 22, a pair of end caps 24, a first spacer 30, a second spacer 32, a tension spring 54, a length of cable 50, an adjustment knob 62, and a pulley assembly 110. The spring tube 22 provides a linear plastic or metal hollow tubular member being approximately two (2) feet in length and having an inner space portion 26 having a diameter of approximately one and one-quarter (1¼) inches, thereby providing a discrete and safe means to house the spring 54 as it expands and contracts during use. A distal portion of the spring tube 22 provides a means to anchor and adjust a length of the spring 54 via a threaded eye bolt 58 which is connected to an end portion of said spring 54 within the spring tube 22. Said eye bolt 58 in turn extends through an aperture portion of the end cap 24 where it is externally threadingly attached to a jam nut 60 and the adjustment knob 62. The jam nut 60, along with a washer 124, are engaged upon said threaded end portion of the eye bolt 58 along an external surface of said end cap 24 to provide selective threaded lengthening or shortening of an internal portion of said eye bolt 58 and also the attached spring 54. The threaded end of the eye bolt 58 provides an attachment means to the adjustment knob 62, thereby lengthening or shortening the spring 54 to adjust a tension force produced by the spring 54.

The opposite end of the spring 54 is internally affixed to the cable 50 using a common "U"-bolt cable clamp 56. The cable 50 protrudes outward from the proximal end of the spring tube 22 through another end cap 24. The extended portion of the cable 50 is guided by the pulley assembly 110 toward the pivot assembly 70. The pulley assembly 110 is affixed to the bottom of that end cap 24 via a first spacer block 30 and an offset rod 68. The pulley assembly 110 comprises a "U"-shaped pulley bracket 112 which axially supports a single-groove metal pulley 114. The first spacer block 30 is attached to that end cap 24 using common threaded fasteners 120 that pass through one end of the offset rod 68. The other end of the offset rod 68 attaches to the pulley assembly 110. The offset rod 68 is an elongated "Z"-shaped member which offsets the horizontal position of the pulley assembly 110 to align the cable 50 coming from the pulley 114 with the spring 54 in the spring tube 22. The spring tube 22 also comprises a second spacer block 32 at an opposing proximal end, also being fastened to the spring tube 22 in a similar manner as the first spacer block 30 using threaded fasteners 120 and corresponding fastener apertures 28. The first 30 and second 32 spacer blocks enable the spring tube 22 to be mounted slightly above the existing fence 102, thereby providing sufficient clearance between the cable 50 and pulley assembly 110, and the subjacent existing fence 102 (see FIG. 1).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: procuring a model of the apparatus 10 compatible with tubular portions a particular manufactured fence 102 onto which the apparatus 10 is to be installed; removing an existing top corner fitting portion of the gate 100 being closest to the hinged edge; replacing said original corner fitting with the custom corner fitting 106 and securing by tightening the set screws 122; inserting the rod portion 74 of the pivot assembly 70 into the rod aperture portion 108 of the custom corner fitting 106; positioning the existing gate 100 and the angle bracket 72 at a desired orientation with regards to the stationary portion of the existing fence 102; securing the angle bracket 72 to the gate 100 by tightening the respective set screws 122; attaching the cable 50 to the cable pinch bolt portion 76 of said angle bracket 72 in a conventional manner; mounting the tensioner assembly 20 to a top surface of an adjacent length of the existing fence 102 using the anchor straps 36; adjusting the tension of the spring 54 acting upon the cable 50 by turning the adjustment knob 62 until obtaining a desired resultant rotary motion of the gate 100; securing said adjustment knob 62 in position by tightening the lock nut 60; and, utilizing the apparatus 10 to automatically bias the gate 100 toward a center or closed position following an opening of said gate 100.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A gate closer comprising:

a pivot assembly having a corner fitting configured to receive a post, said corner fitting including an orifice and a first set screw and a second set screw, said second set screw for engaging a received post, said pivot assembly further including an angle bracket extending from said corner fitting and a rod fixed to and extending from said angle bracket, wherein said rod passes into said orifice to be held in place by said first set screw;

a tensioner assembly having a spring tube, a first end cap on a first end of said spring tube, a second end cap on a second end of said spring tube, a spring inside said spring tube, and a threaded fastener extending through said second end cap;

a pulley assembly externally attached to said tensioner assembly, said pulley assembly including a pulley and a "U" shaped pulley bracket; and, a cable attached at one end to said pivot assembly and operatively connected to said spring at the other end, said cable passing across said pulley and through said first end cap.

2. The gate closer of claim 1, wherein said pivot assembly further comprises:

a pinch bolt connecting said angle bracket to said cable.

3. The gate closer of claim 1, wherein said tension adjustment comprises:

an adjustment knob on said threaded fastener; and, a nut threaded onto said threaded fastener, said nut being external to said spring tube and abutting said second end cap;

wherein said threaded fastener includes an eyelet connected to said spring.

4. The gate closer of claim 1, wherein said pulley guides said cable from said tensioner assembly to said pivot assembly.

5. The gate closer of claim 1, further comprising:

a spacer block attached to said spring tube and including an aperture formed therein; and, an offset rod having a proximal end attached to said pulley assembly and a distal end inserted into said aperture;

wherein said pulley axially aligns said cable with said spring.

* * * * *